US006305145B2

(12) United States Patent
Suolahti

(10) Patent No.: US 6,305,145 B2
(45) **Date of Patent: *Oct. 23, 2001**

(54) WRAPPING APPARATUS

(75) Inventor: Yrjö Suolahti, Masku (FI)

(73) Assignee: Oy M. Haloila AB, Masku (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/244,991

(22) Filed: Feb. 4, 1999

(30) Foreign Application Priority Data

Feb. 11, 1998 (FI) ..... 980315

(51) Int. Cl.[7] ..... B65B 57/02; B65B 11/28

(52) U.S. Cl. ..... 53/64; 53/588; 53/204; 53/389.4; 242/420.6

(58) Field of Search ..... 53/588, 556, 204, 53/64, 389.4; 100/12, 27; 242/420.6

(56) References Cited

U.S. PATENT DOCUMENTS

| | | | | |
|---|---|---|---|---|
| 2,285,654 | * | 6/1942 | Hanna et al. | 53/64 |
| 4,590,746 | * | 5/1986 | Humphrey | 53/389.4 |
| 4,712,354 | * | 12/1987 | Lancaster et al. | 53/588 |
| 4,829,753 | * | 5/1989 | Bricmont | 53/204 |
| 4,840,006 | * | 6/1989 | Humphrey | 53/64 |
| 5,080,296 | * | 1/1992 | Raggio et al. | 242/420.6 |
| 5,248,104 | * | 9/1993 | Groos et al. | 242/420.6 |
| 5,755,083 | * | 5/1998 | Cleine | 53/588 |
| 5,829,234 | * | 11/1998 | Suolahti | 53/588 X |

FOREIGN PATENT DOCUMENTS

| | | |
|---|---|---|
| 41 41 705 | 6/1993 | (DE) . |
| 44 13 838 | 11/1994 | (DE) . |
| 195 45 812 | 6/1997 | (DE) . |
| 0 306 573 | 3/1989 | (EP) . |
| 0 524 819 | 1/1993 | (EP) . |
| 0 544 312 | 6/1993 | (EP) . |
| 91623 | 4/1994 | (FI) . |
| 101281 | 5/1998 | (FI) . |
| 93 24373 | 12/1993 | (WO) . |

* cited by examiner

*Primary Examiner*—Stephen F. Gerrity
(74) *Attorney, Agent, or Firm*—Lowe Hauptman Gilman & Berner, LLP

(57) ABSTRACT

Wrapping apparatus for winding a wrapping foil web (F) around an object (1) includes a foil dispenser (2) arranged to circulate along a ring-like endless track (3) around the object to be packaged. The foil dispenser (2) comprises a frame (4), a detachable and replaceable foil roll (5) mounted on the frame, supporting elements (6) for supporting the foil roll on the frame, and tensioning arrangements (7) for braking foil delivery from the roll and maintaining a predetermined foil tension. The tensioning arrangements (7) comprise a sensor (8) for detecting foil web tension, and an electric motor (9) for driving the foil roll (5). The torque, speed of rotation and direction of rotation of the electric motor is controlled on the basis of foil tension as detected by the sensor.

14 Claims, 3 Drawing Sheets

61
62
60
35
31
3
33
1
34
32
F
2
5
29
30
4
II
28
I

WRAPPING APPARATUS

BACKGROUND OF THE INVENTION

The present invention relates to a wrapping apparatus.

Prior specification EP 0 544 312 A1 discloses a wrapping apparatus for winding a web of wrapping foil around an object to be packaged. This wrapping apparatus comprises a foil dispenser arranged to circulate along a ring-like endless track around the object to be packaged. In the prior-art apparatus the track is of a substantially elliptical form. The track comprises a straight track portion which passes through the center hole of the cylindrical object to be packaged. The straight track portion extends outside the hole to a distance from the end of the cylindrical object. The track also comprises a curved portion which forms a curved track between ends of the straight track portion and around the object to be packaged. The foil dispenser comprises a frame and a detachable and replaceable foil roll mounted on the frame. Furthermore, the foil dispenser comprises supporting elements for supporting the foil roll on the frame, and tensioning means for braking the delivery of foil from the roll to maintain a predetermined foil tension.

A special problem which arises from the form of the track is that, during wrapping, in certain parts along the track, the foil span (i.e. a portion of the foil extending between a support point, e.g. edge point, of the object to be packaged and the foil dispenser) does not lengthen, but, instead, becomes shorter. Therefore the foil web would slacken if the tensioning device would not eliminate the slack. In EP 0 544 312 A1, the foil tensioning device is a complicated mechanical foil storage device comprising a number of fixedly mounted deflecting rollers, a number of flexibly mounted deflecting rollers and loading means for flexibly applying to the flexibly mounted rollers a load acting in a direction away from the fixedly mounted rollers so as to maintain tension in a variable amount of foil web passing along a winding path around the deflecting rollers.

A problem with this prior-art apparatus is that the foil storage takes up a relatively large space in the foil dispenser. Moreover, the structure is heavy, complex and expensive. Especially in types of wrapping apparatus in which the foil dispenser should be as small as possible to be able to pass e.g. through the central hole of a foil roll, the large size of the prior-art structure leads to problems. The heavy weight again results in a necessity to use a foil dispenser drive mechanism and motor accordingly dimensioned.

An object of the present invention is to eliminate the drawbacks described above.

A specific object of the present invention is to present a wrapping apparatus in which the foil dispenser is as simple as possible, contains few components and is light and cheap.

SUMMARY OF THE INVENTION

According to the invention, the tensioning arrangement comprises a sensor for continuously sensing foil web tension and an electric motor for driving the foil roll. The torque, speed of rotation and direction of rotation of the electric motor are controlled on the basis of foil tension as detected by the sensor such that a foil tension is achieved that remains within predetermined limits.

The invention has the advantage that, to maintain a sufficient foil tension, the foil roll can be caused to rotate in the direction of foil delivery as well as in the opposite direction as necessary according to the measured foil tension. As the inertia of the foil roll in certain situations tends to cause excessive foil delivery, the torque of the electric motor is increased or decreased as necessary in accordance with the foil tension as detected by the sensor. Also the speed of rotation of the electric motor can be controlled. The foil dispenser contains few parts and is simple, small, light and cheap.

In one embodiment of the apparatus, the foil dispenser comprises a first diverting element which is connected to the frame and around which the foil web drawn from the foil roll passes. The said first diverting element contacts the first side of the foil. A second diverting element is connected to the frame at a distance from the first diverting element and also contacts the first side of the foil. The sensor comprises a spring-loaded lever arm, a turning axle, which is supported by a bearing on the frame and to which the lever arm is attached, and a third diverting element, which is connected to the end of the lever arm between the first and second diverting elements. The third diverting element contacts the second side of the foil, so that the foil web passing between the first and second diverting elements over the third diverting element, which is capable of a springing motion, forms a bend that comprises a varying length of foil web.

In an embodiment of the apparatus, the sensor comprises a potentiometer so connected to the turning axle that the resistance of the potentiometer changes as a function of the angle of rotation of the turning axle, the angle being directly proportional to the tension of the foil web, to produce a control signal for controlling the speed and direction of rotation of the electric motor.

In an embodiment of the apparatus, the electric motor is a direct-current motor.

In an embodiment of the apparatus, the supporting elements for supporting the foil roll comprise a first supporting element, which is rotatably mounted with a bearing on the frame and fitted to support the foil roll from the side of its first end face, and a second supporting element, which is fitted to support the roller from the side of its second end face opposite to the first end face. The second supporting element comprises a drive shaft supported by a bearing on the frame. The drive shaft is driven by the electric motor.

In an embodiment of the apparatus, the apparatus has a first wheel, such as a belt pulley or the like, mounted on the drive shaft. Mounted on the shaft of the electric motor is a second wheel, such as a belt pulley or the like. A first endless traction means, such as a belt or the like, extends over the first and second wheels to transmit the power of the electric motor to the drive shaft.

In an embodiment of the apparatus, the apparatus has a third wheel, such as a belt pulley or the like, attached to the turning axle. Connected to the potentiometer is a fourth wheel. A second endless traction means, such as a belt or the like, extends the third and fourth wheels to transmit the rotation of the turning axle into rotation of the potentiometer.

In an embodiment of the apparatus, the wrapping apparatus comprises a machine frame supporting a wrapping ring arranged to guide the motion of the foil dispenser. The wrapping ring comprises two ring sections movable relative to each other between two positions. These positions are an open position, in which the ring sections have a port opening between them, and a closed position, in which the port opening is closed and the wrapping ring forms the endless ring-like track. The object to be packaged being a cylindrical body, such as a band roll, having a central hole going through it, the wrapping ring in its closed position has been arranged to pass through the central hole.

In an embodiment of the apparatus, the track is of a substantially elliptical form. The track comprises a straight track portion, which, in the closed position of the wrapping ring, passes through the hole in the object to be packaged and extends outside the hole to a distance from the end of the cylindrical object, and a curved portion which forms a curved track between the ends of the straight track portion and around the object to be packaged.

BRIEF DESCRIPTION OF THE DRAWING

In the following, the invention will be described in detail by the aid of a few examples of its embodiments by referring to the attached drawings, in which.

DETAILED DESCRIPTION OF THE INVENTION

Figure 1:
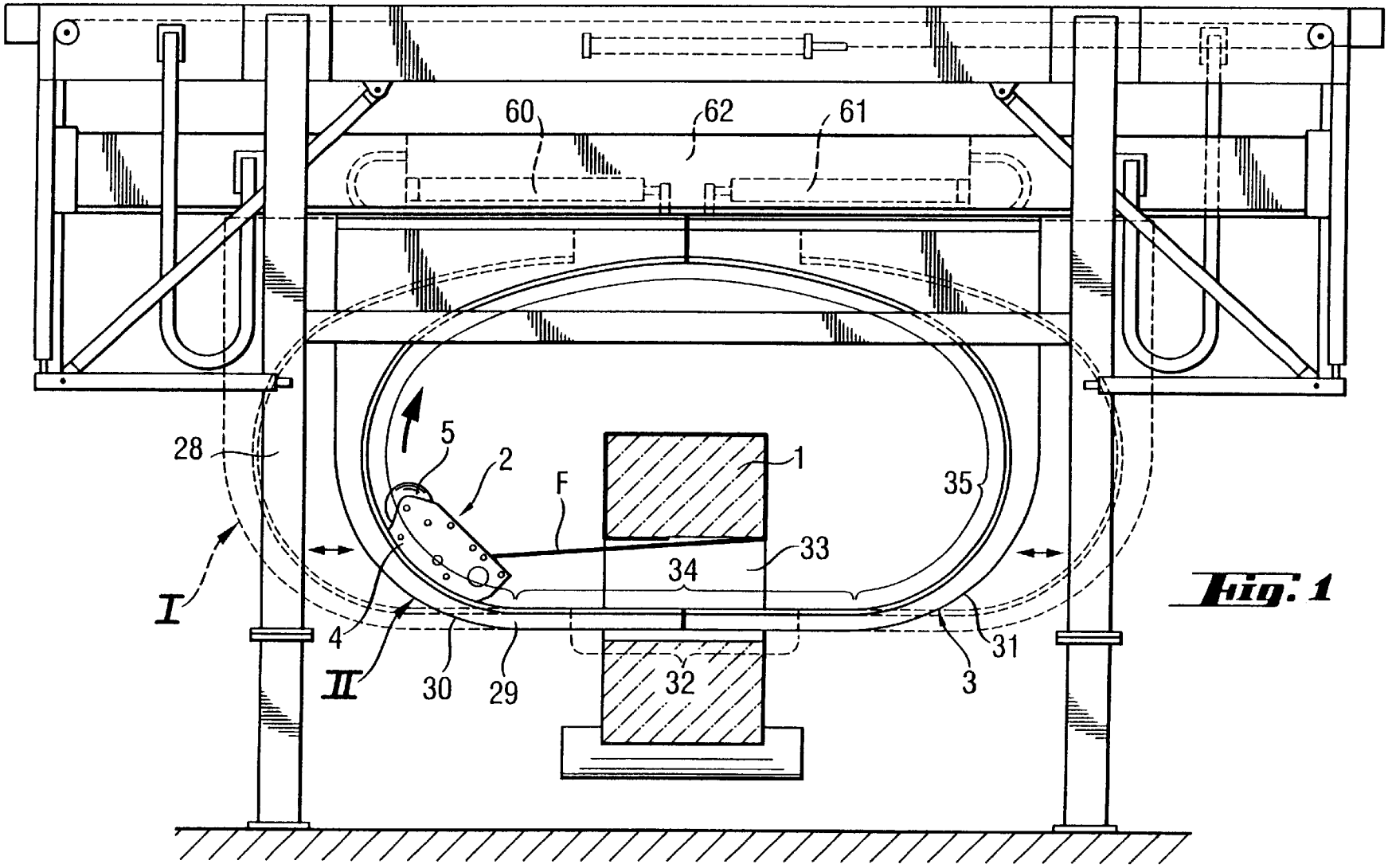
FIG. 1 is an elevational view of an embodiment of the apparatus of the invention.

FIG. 1 shows a wrapping apparatus for winding a web of wrapping foil around an object 1 to be packaged. The wrapping apparatus comprises a foil dispenser 2 arranged to circulate along an endless ring-like track 3 around the object 1. In the figure, the object 1 to be packaged is a roll of steel band, which rests on a base provided with a turning gear, e.g. turning rollers, so that the band roll 1 can be turned about its horizontal symmetry axis during the wrapping operation. The band roll 1 has a central hole 33 extending through the roll.

The wrapping apparatus comprises a machine frame 28 supporting a wrapping ring 29, arranged to guide the motion of the foil dispenser 2. The wrapping ring 29 is comprised of two ring sections 30, 31 which are movable relative to each other with the aid of power means 60 and 61 between two positions I and II, for which purpose the ring sections 30 and 31 are supported by a horizontal guide beam 62. In the open position I, which in FIG. 1 is depicted with broken lines, the ring sections 30, 31 have a port opening 32 there between to receive band roll 1 into the wrapping station. In the a closed position II, the port opening 32 is closed and the wrapping ring forms the endless ring-like track 3 referred to above. The track 3 comprises a horizontal track portion 34, which in the closed position II of the wrapping ring 29 passes through the hole 33 in the object 1 to be packaged, and a curved portion 35, which, outside the hole, forms a curved track around the object to be packaged.

Figure 2:
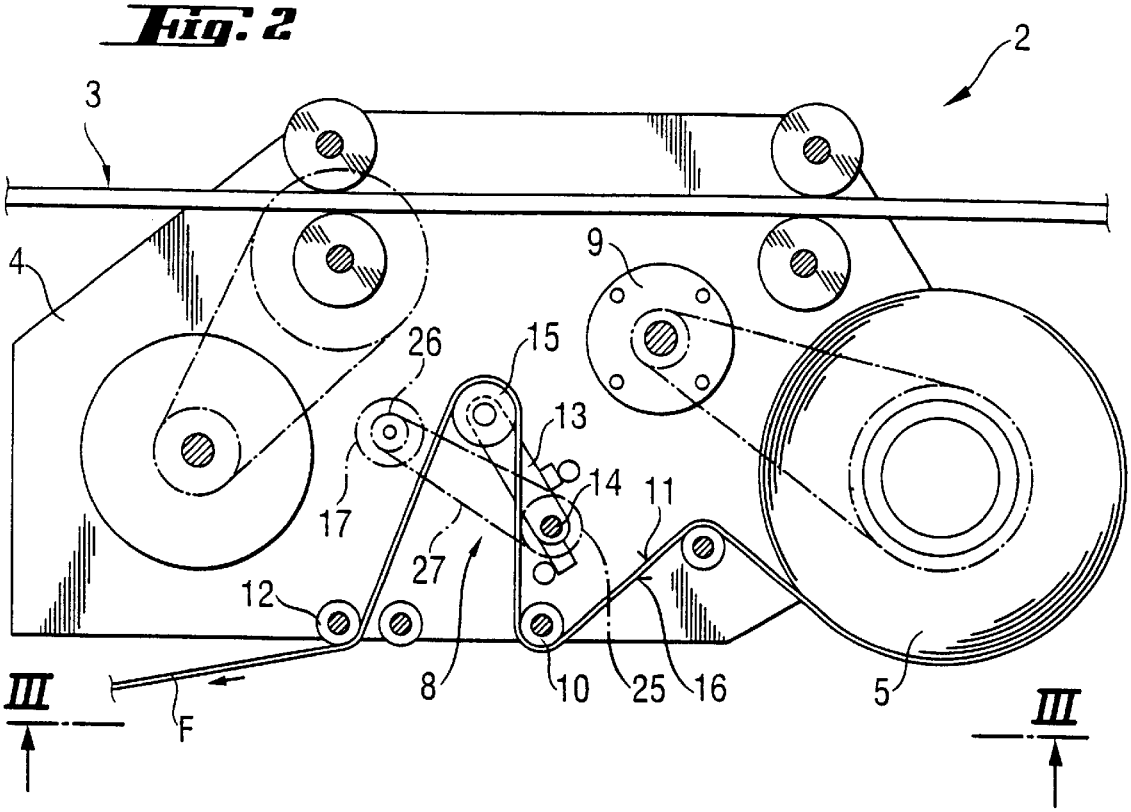
FIG. 2 is a plain view of a foil dispenser in an apparatus of by FIG. 1.
Figure 3:
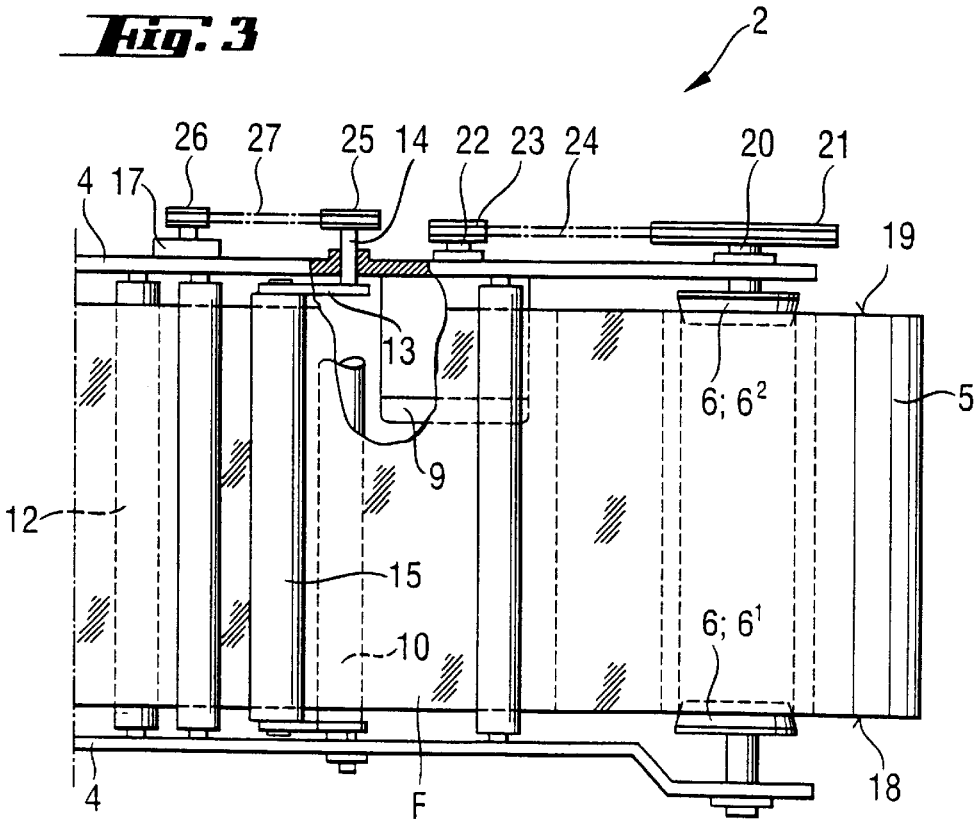
FIG. 3 is a view of the foil dispenser taken in the direction III—III of FIG. 2.

FIGS. 2 and 3 illustrate the foil dispenser 2, with a removable and replaceable foil roll 5 supported on a frame 4 by supporting elements 6. The foil dispenser is provided with a sensor 8 for detecting foil web tension. Moreover, the foil dispenser 2 has an electric motor 9 for driving the foil roll 5. The torque of the electric motor 9 is continuously controlled on the basis of the foil tension as detected by the sensor 8 so that an appropriate foil tension is maintained, ensuring that the foil is always at a suitable tightness as it is laid onto the surface of the object, being packaged. To maintain tightness, the electric motor 9 can also drive the foil roll in the reverse direction as necessary.

The foil dispenser 2 comprises a first diverting element 10, which is connected to the frame 4. The foil web F drawn from the foil roll 5 passes over the first diverting element 10 in contact with the first side 11 of the foil. A second diverting element 12 is connected to the frame 4 at a distance from the first diverting element 10. The second diverting element 12 also contacts the first side 11 of the foil.

The sensor 8 comprises a spring-loaded lever arm 13. The turning axle 14 to which the lever arm is attached is supported by a bearing on the frame 4. A third diverting element 15 is connected to the end of the lever arm 13 between the first and second diverting elements 10, 12. The third diverting element 15 contacts the second side 16 of the foil. The foil web passing between the first and second diverting elements 10, 15 over the third diverting element 15, which is capable of a springing motion, forms a bend that comprises a varying length of foil web.

The sensor 8 further comprises a resistance potentiometer 17, which is so connected to the turning axle 14 that the resistance of the potentiometer changes as a function of the angle of rotation of the turning axle 14, said angle being directly proportional to the tension of the foil web, to produce a control signal for the electric motor 9. Attached to the turning axle 14 is a third wheel 25, such as a belt pulley or the like. A fourth wheel 26 is connected to the resistance potentiometer 17. A second endless traction means 27, such as a belt or the like, is trained around the third and fourth wheels to transmit the rotation of the turning axle into rotation of the resistance potentiometer 17.

The supporting elements 6 carrying the foil roll 5 on the frame 4 comprise a first supporting element $6^1$, which is rotatably mounted with a bearing on the frame 4 and fitted to support the foil roll 5 from the side of its first end face 18, and a second supporting element $6^2$, which is fitted to support the roller from the side of its second end face 19 opposite to the first end face. The second supporting element $6^2$ comprises a drive shaft 20 supported by a bearing on the frame 4 and fitted to be driven by the electric motor 9. Mounted on the drive shaft 20 is a first wheel 21, such as a belt pulley or the like. Mounted on the shaft 22 of the electric motor 9 is a second wheel 23, such as a belt pulley or the like. An endless first traction means 24, such as a belt or the like, runs over the first wheel 21 and the second wheel 23 to transmit the power of the electric motor 9 to the drive shaft 20.

Figure 4:
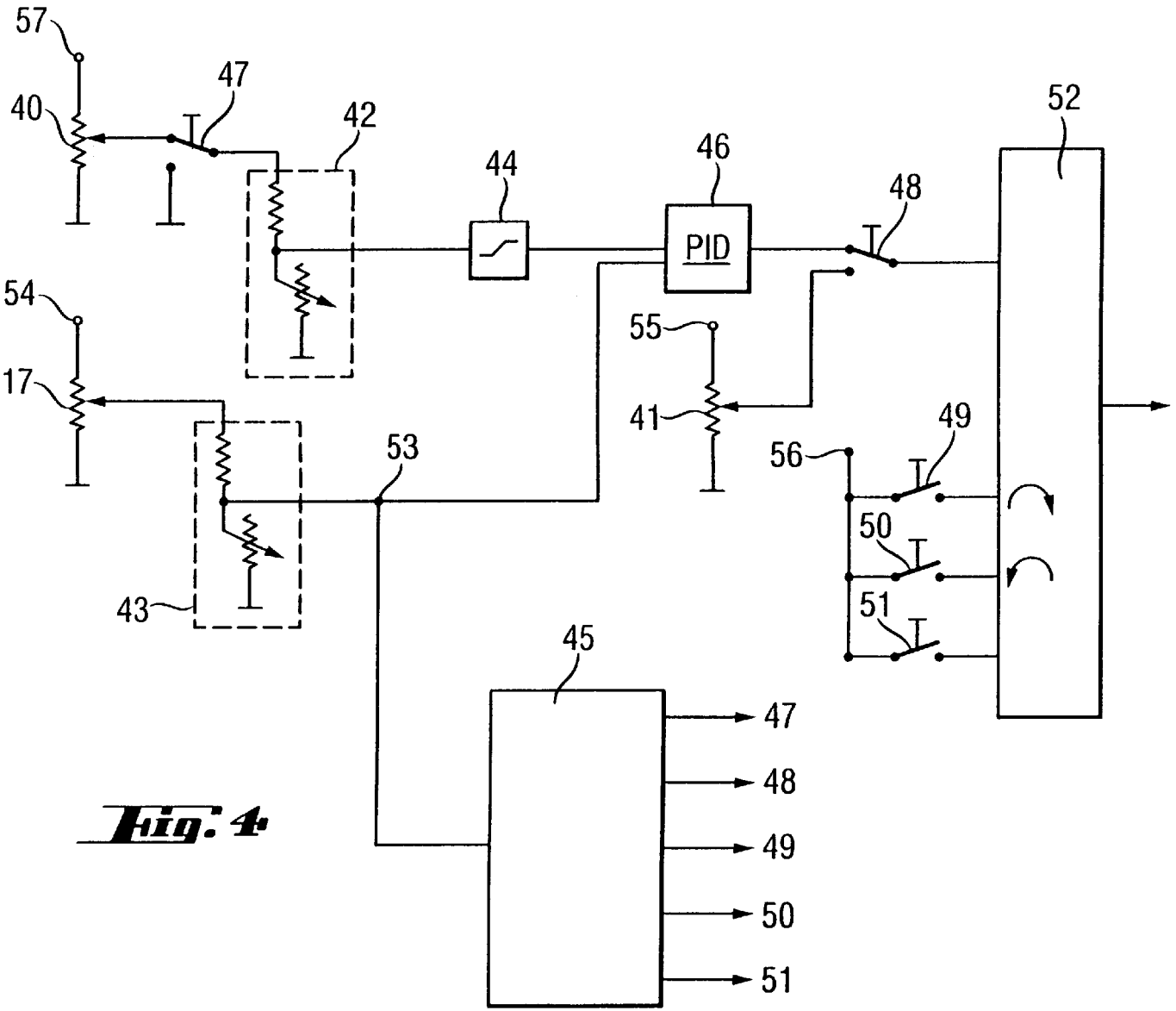
FIG. 4 is a control circuit for controlling the electric motor in the foil dispenser and working in conjunction with the foil roll.

FIG. 4 presents an example of a control system that can be used to control the operation of the electric motor 9. The electric motor 9 is regulated by means of a control card 52. The regulation comprises various states, which are controlled by a logic circuit 45. The output of the control logic circuit controls relay switches 47–51. The input to the logic circuit 45 is a voltage 53 obtained from the resistance potentiometer 17 and scaled to a suitable voltage range by means of circuit 43. 55, 56 and 57 are in the same potential as operating voltage.

The output of the control logic circuit 45 provides three control states:

1. Slack foil is rewound by causing the electric motor 9 to rotate in the direction opposite to the wrapping direction.

2. The foil is subjected to initial tensioning by causing the electric motor 9 to rotate, in the wrapping direction.

3. The electric motor 9 is caused to rotate at a constant speed in the wrapping direction.

To rewind slack foil, the control logic circuit 45 connects control relay 48 to the output of potentiometer 41, which gives a speed reference for the electric motor 9. Control relay 49 connects a control voltage 56 to the control card 52, defining that the electric motor 9 is to be rotated in the direction opposite to the wrapping direction.

Initial tensioning of the foil is started by connecting control relay 47 to the output of potentiometer 40, control relay 48 to the output of PID controller 46 and control relays 49 and 51 to the control voltage 56. Integrator 44 receives a control voltage from potentiometer 40, scaled to a suitable voltage range by circuit 42. From the output of the PID controller 46, the electric motor 9 receives a speed reference to be used for tensioning the foil to a reference tension. The reference tension is adjusted by means of potentiometer 40. When the integrator reaches the reference tension, control relay 50 is connected to the control voltage 56, permitting foil feed.

The invention is not restricted to the examples of its embodiments described above, but many variations are possible within the scope of the inventive idea defined by the claims.

What is claimed is:

1. Wrapping apparatus for winding a wrapping foil web (F), fed from a replaceable foil roll (5), around an object (1) to be packaged, said wrapping apparatus comprising an endless track and a foil dispenser (2) arranged to circulate along the endless track (3) around the object to be packaged, said foil dispenser (2) including a frame (4) for detachably receiving the replaceable foil roll (5), supporting elements (6) for supporting the foil roll on the frame, and a tensioning arrangement mounted on the frame for maintaining a predetermined foil tension of the foil web, said tensioning arrangement including a sensor (8) for detecting foil tension of the foil web, a control system receiving output from the sensor, and an electric motor (9) controlled by the control system for driving the foil roll (5), wherein the torque, speed of rotation and direction of rotation of said electric motor are controlled by the control system on the basis of the foil tension detected by the sensor.

2. Apparatus as defined in claim 1, wherein said foil dispenser (3) further comprises a first diverging element (10) connected to the frame (4) and around which the foil web drawn from the foil roll (5) is adapted to pass, said first diverging element contacting a first side (11) of the foil, and a second diverting element (12) connected to the frame at a distance from the first diverting element, said second diverting element contacting the first side (11) of the foil; and said sensor (8) comprises a spring-loaded lever arm (13) connected to a turning axle (14) supported by a bearing on the frame (4), and a third diverting element (15) connected to an end of the lever arm between the first and second diverting elements, said third diverting element contacting a second side (16) of the foil, so that the foil web passing between the first and second diverting elements over the third diverting element, which is capable of a springing motion, forms a bend that comprises a varying length of foil web.

3. Apparatus as defined in claim 2, wherein said sensor (8) comprises a potentiometer (17) so connected to the turning axle (14) that a resistance of the potentiometer changes as a function of an angle of rotation of the turning axle, said angle being directly proportional to the foil tension of the foil web to produce a control signal for controlling the electric motor (9).

4. Apparatus as defined in claim 3, wherein the supporting elements (6) for supporting the foil roll comprise a first supporting element ($6^1$) rotatably mounted with a bearing on the frame and fitted to support the foil roll from a side of a first end face (18) of the foil roll, and a second supporting element ($6^2$) fitted to support the roller from a side of a second end face (19) thereof opposite the first end face, said second supporting element ($6^2$) comprising a drive shaft (20) supported by a bearing on the frame (4), said drive shaft being driven by the electric motor (9).

5. Apparatus as defined in claim 4, further comprising a first wheel (21) mounted on the drive shaft (20) and a second wheel (23) mounted on a shaft (22) of the electric motor (9); and a first endless traction member (24), arranged to run over the first and second wheels to transmit the power of the electric motor to the drive shaft.

6. Apparatus as defined in claim 3, further comprising a third wheel (25) attached to the turning axle (14); a fourth wheel (26) connected to the potentiometer (17); and a second endless traction member (27) arranged to run over the third and fourth wheels to transmit the rotation of the turning axle into rotation of the potentiometer.

7. Apparatus as defined in claim 1, wherein the electric motor (9) is a direct-current motor.

8. Apparatus as defined in claim 1, wherein said wrapping apparatus further comprises a machine frame (28) supporting a wrapping ring (29) arranged to guide the motor of the foil dispenser (2), said wrapping ring (29) comprising two ring sections (30, 31) movable relative to each other between, an open and a closed position, in the open position said ring sections (30, 31) have a port opening (32) therebetween, and in the closed position said port opening is closed and the wrapping ring forms said endless track (3); wherein the object (1) to be packaged is a cylindrical body having a central hole (33) and the wrapping ring (29) in its closed position is arranged to pass through the central hole.

9. Apparatus as defined in claim 8, wherein the track (3) is of a substantially elliptical form that comprises a straight track portion (34) which, in the closed position of the wrapping ring (29), passes through the hole (33) and extends outside the hole (33) to a distance from the end of the cylindrical object (1), and a curved portion (35) which, outside the hole, forms a curved track between the opposite ends of the straight track portion and around the object to be packaged.

10. Apparatus according to claim 1, wherein an output of said control system provides the following three control states:

a) slack foil is rewound by causing the electric motor to rotate in a direction opposite to a wrapping direction;

b) the foil is subjected to initial tensioning by causing the electric motor to rotate in the wrapping direction; or c) the electric motor is caused to rotate at a constant speed in the wrapping direction.

11. Apparatus according to claim 1, wherein the control system comprises a reference speed circuit for supplying a first control signal to the electric motor, to control the electric motor to rotate in the direction opposite to the wrapping direction.

12. Apparatus according to claim 1, wherein the control system comprises a reference tension circuit for supplying a second control signal to the electric motor, to control the electric motor to rotate until the foil tension detected by the sensor reaches the reference tension.

13. Apparatus according to claim 12, wherein the control system further comprises a control relay for supplying a third control signal to the electric motor when the foil tension detected by the sensor has reached the reference tension, thereby permitting foil feed from the foil roll.

14. Apparatus according to claim 1, wherein the torque of the electric motor is continuously controlled by the control system based on the foil tension detected by the sensor.

* * * * *